US005242508A

United States Patent [19]

McCallum et al.

[11] Patent Number: 5,242,508

[45] Date of Patent: Sep. 7, 1993

[54] METHOD OF MAKING PERMANENT MAGNETS

[75] Inventors: R. William McCallum; Kevin W. Dennis; Barbara K. Lograsso; Iver E. Anderson, all of Ames, Iowa

[73] Assignee: Iowa State University Research Foundation, Inc., Ames, Iowa

[21] Appl. No.: 869,897

[22] Filed: Apr. 15, 1992

Related U.S. Application Data

[63] Continuation of Ser. No. 593,944, Oct. 9, 1990, abandoned.

[51] Int. Cl.[5] ..... H01F 1/08

[52] U.S. Cl. ..... 148/101; 148/105; 75/332; 75/338; 75/349

[58] Field of Search ..... 75/332, 338, 339, 348, 75/349; 148/101, 105

[56] References Cited

U.S. PATENT DOCUMENTS

| | | | |
|---|---|---|---|
| 3,663,317 | 5/1972 | Westendorp et al. | 148/103 |
| 3,904,448 | 9/1975 | Takahashi et al. | 75/348 |
| 4,104,787 | 8/1978 | Jandeska et al. | 29/596 |
| 4,290,826 | 9/1981 | Clegg | 148/101 |
| 4,402,770 | 9/1983 | Koon | 148/302 |
| 4,533,408 | 8/1985 | Koon | 148/103 |
| 4,585,473 | 4/1986 | Narasimhan et al. | 75/338 |
| 4,597,938 | 7/1986 | Matsuura et al. | 419/23 |
| 4,601,875 | 7/1986 | Yamamoto et al. | 419/23 |
| 4,619,845 | 10/1987 | Ayers et al. | 427/422 |
| 4,636,353 | 1/1987 | Seon et al. | 420/416 |
| 4,664,724 | 5/1987 | Mizoguchi et al. | 148/302 |
| 4,770,723 | 9/1988 | Sagawa et al. | 148/302 |
| 4,801,340 | 1/1989 | Inoue et al. | 148/103 |
| 4,802,931 | 2/1989 | Croat | 148/302 |
| 4,834,812 | 5/1989 | Ghandehari | 148/101 |
| 4,867,809 | 9/1989 | Haverstick | 148/101 |
| 4,911,882 | 3/1990 | Greenwald | 419/12 |

FOREIGN PATENT DOCUMENTS

| | | | |
|---|---|---|---|
| 63-100108 | 5/1988 | Japan | 75/338 |
| 63-109101 | 5/1988 | Japan | 148/105 |
| 63-211706 | 9/1988 | Japan | 75/348 |

OTHER PUBLICATIONS

Hot-Pressed Neodymium-Iron-Boron Magnets, R. W. Lee, Appl. Phys. Lett., 1985.

Iron-Based Rare-Earth Magnets, J. J. Croat, Chairperson, J. Appl. Phys., 1985.

Nd—Fe—B Permanent Magnet Materials, Japanese Journal of Applied Science, 1987, Masato Sagawa et al.

Processing of Neodymium-Iron-Boron Melt-Spun Ribbons to Fully Dense Magnets, R. W. Lee et al., IEE Transactions on Magnetics, 1985.

Flow Measurements in Gas Atomization Processes, R. S. Figliola et al., 1989.

Permanent Magnet Materials Based on the Rare Earth-Iron-Boron Tetragonal Compounds, M. Sagawa et al., IEE Transactions on Magnetics, 1985.

New Material for Permanent Magnets on a Base of Nd and Fe, M. Sagawa et al., American Institute of Physics, 1984.

Materials Research for Advanced Inertial Instrumentation, D. Das et al., 1978.

Low oxygen processing of $SmCo_5$ magnets, K. S. V. L. Narasimhan, J. Appl. Phys., 1981.

Fluid Flow Effects in Gas Atomization Processing, I. E. Anderson et al., International Symposium on the Physical Chemistry of Powder Metals Production and Processing, 1989.

Observations of Gas Atomization Process Dynamics, I. E. Anderson et al., MPIF-AMPI, 1988.

*Primary Examiner*—George Wyszomierski

*Attorney, Agent, or Firm*—Tilton, Fallon, Lungmus & Chestnut

[57] ABSTRACT

A method for making an isotropic permanent magnet comprises atomizing a melt of a rare earth-transition metal alloy (e.g., an Nd—Fe—B alloy enriched in Nd and B) under conditions to produce protectively coated, rapidly solidified, generally spherical alloy particles wherein a majority of the particles are produced/-size classified within a given size fraction (e.g., 5 to 40 microns diameter) exhibiting optimum as-atomized magnetic properties and subjecting the particles to concurrent elevated temperature and elevated isotropic pressure for a time effective to yield a densified, magnetically isotropic magnet compact having enhanced magnetic properties and mechanical properties.

20 Claims, 11 Drawing Sheets

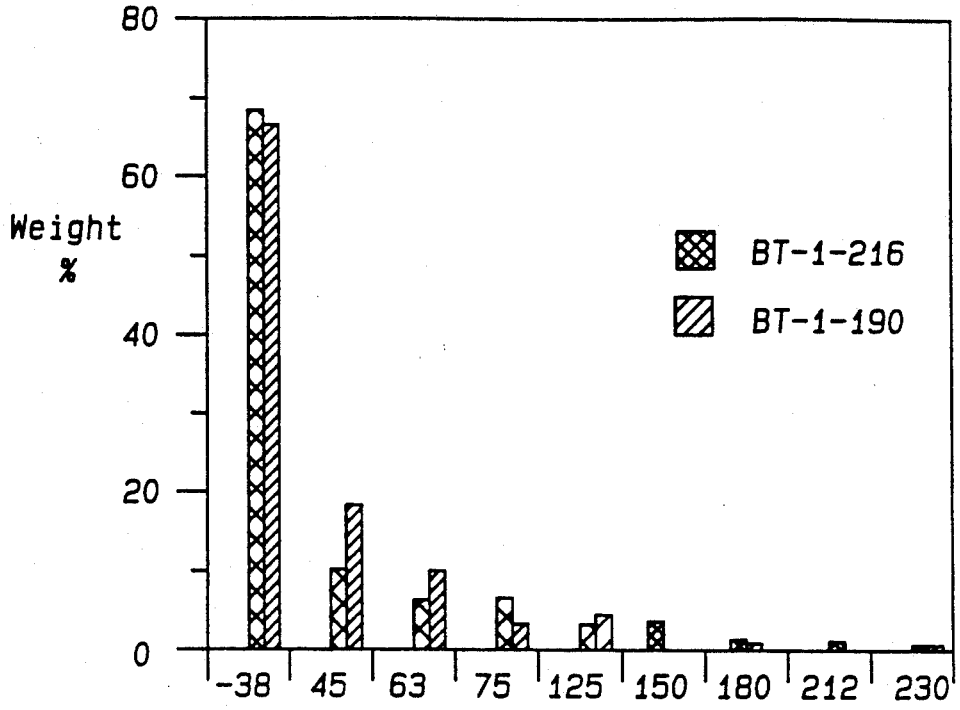
Fig-5 Particle Size (um)
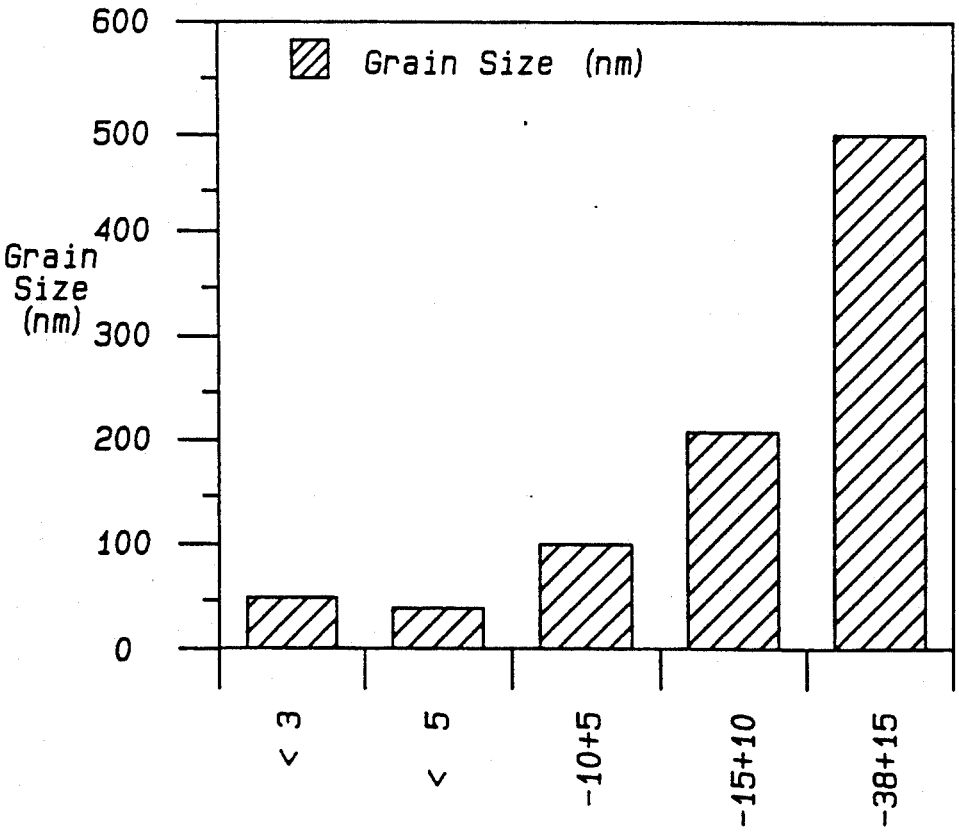
Fig-8 Particle Size (um)

$r_2 - r_0 = 2.5(r_1 - r_0)$

METHOD OF MAKING PERMANENT MAGNETS

CONTRACTUAL ORIGIN OF REFERENCE AND GRANT REFERENCE

The United States Government has rights in this invention pursuant to the Contract No. W-7405-ENG-82 between the U.S. Department of Energy and Iowa State University, Ames, Iowa, which contract grants to Iowa State University Research Foundation, Inc. the right to apply for this patent. The research leading to the invention was supported in part by U.S. Department of Commerce Grant ITA 87-02.

This is a continuation of copending application Ser. No. 07/593,944 filed on Oct. 9, 1990, now abandoned.

FIELD OF THE INVENTION

The present invention relates to a method of making rare earth-transition metal alloy permanent magnets characterized by isotropic microstructures and magnetic properties.

BACKGROUND OF THE INVENTION

A large amount of technological interest has been focused on rare earth-iron-boron alloys (e.g., 26.7 weight % Nd-72.3 weight % Fe-1.0 weight %-B) as a result of their promising magnetic properties for permanent magnet applications attributable to the magnetically hard $Nd_2Fe_{14}B$ phase. Commercial permanent magnets of these alloys having anisotropic, aligned structure exhibit high potential energy products (i.e., BHmax) of 40–48 MGOe while those having an isotropic, non-aligned structure exhibit potential energy products of 5–10 MGOe. Such energy product levels are much higher than those exhibited by Sm-Co alloys (e.g., $SmCo_5$ and $Sm_2Co_{17}$) previously regarded as having optimum magnetic properties. The rare earth-iron-boron alloys are also advantageous over the SmCo alloys in that the rare earth (e.g., Nd) and Fe are much more abundant and economical than Sm and Co. As a result, rare earth-iron-boron permanent magnets are used in a wide variety of applications including, but not limited to, audio loud speakers, electric motors, generators, meters, scientific instruments and the like.

Two different approaches are currently in use to produce isotropic permanent magnets from rare earth-iron-boron alloys (e.g., Nd—Fe—B). One approach involves rapidly solidifying the Nd—Fe—B alloy by melt spinning to produce a near-amorphorous, fine grained ribbon material, mechanically comminuting the ribbon to form flake particulates, and then vacuum hot pressing the flakes in a die cavity to consolidate the material. This approach suffers from numerous disadvantages such as microstructural inhomogeneities induced by non-uniform quenching, contamination and non-ideal particle shape (e.g., thin platelets) for further magnet fabrication operations. The vacuum hot pressing operation typically requires at least brief exposure to a partial liquidification (melting) temperature to enhance interparticle bonding.

The second approach involves mechanical comminution of a chill cast ingot and "powder metallurgy" consolidation of the resulting fine comminuted alloy powder wherein the fine comminuted powder is pressed and sintered using liquid phase sintering and long time anneals (e.g., total anneal times up to 25 hours) to consolidate the powder. This latter approach has traditionally been used to fabricate SmCo, ferrite and other types of magnets. This latter approach suffers from numerous disadvantages such as explosibility hazards, contamination, microstructural inhomogeneities, excessive grain growth and, as mentioned, long processing times.

Both of the aforementioned fabrication approaches thus are disadvantageous in that they involve difficult-to-process, irregular-shape alloy particulates using complex, time consuming and high cost particulate processing and heat treatment techniques. The magnets fabricated in these ways from such alloy particulates are prone to inhomogeneities in microstructure and composition that can adversely affect the desired isotropic magnetic properties of the magnet.

It is an object of the present invention to provide a method of making isotropic permanent magnets from rare earth-transition metal (e.g., iron) alloy particles in a manner that overcomes the disadvantages of the fabrication approaches described hereinabove.

It is another object of the present invention to provide a method of making isotropic permanent magnets from rare earth-transition metal alloy particles wherein processing times and steps are reduced and simplified and wherein the excessive heat treatment requirements of the fabrication approaches described hereinabove are eliminated so as to reduce the cost of producing the isotropic magnets.

It is still another object of the present invention to provide a method of making isotropic permanent magnets from rare earth-transition metal alloy particles wherein the microstructures and compositions of the fabricated magnets exhibit improved homogeneity as compared to isotropic permanent magnets fabricated by the approaches described hereinabove.

It is still a further object of the present invention to provide a method of making isotropic permanent magnets from rare earth-transition metal alloy particles wherein the magnets have dramatically improved mechanical strength.

SUMMARY OF THE INVENTION

The present invention involves a method of making isotropic permanent magnets by providing generally spherical, rapidly solidified rare earth-transition metal alloy particles exhibiting desirable magnetic properties for the particular alloy composition and magnet service application involved. Preferably, the particles are provided by atomizing a melt of a rare earth-transition metal alloy under conditions to produce a majority of particles falling within a given particle size range (thus a given grain size range) exhibiting desirable (e.g., near optimum) magnetic properties in the as-atomized condition. The particles in the given size range are then subjected to concurrent elevated temperature and elevated isotropic pressure for a time to yield a densified magnet compact or body having improved magnetic properties (e.g., energy product, coercivity, remanence) as compared to the as-atomized particles and dramatically improved strength as compared to rare earth-transition metal alloy magnets available heretofore.

In one embodiment of the invention, the majority of the atomized particles have a particle size (diameter) less than a given particle diameter. Particles having a particle diameter greater than the given diameter are initially selectively removed from the particle batch by screening or other size classifying techniques and the remaining particles are then subjected to the elevated temperature/pressure step to form the magnet compact or body.

In another embodiment of the invention, the particles are subjected to one or more size classifying techniques to provide multiple individual particle size fractions that each exhibit a grain size in a relatively narrow range in the as-atomized condition. A particular particle size fraction can then be subjected to the elevated temperature/pressure step.

In still another embodiment of the invention, the particles are treated to form an environmentally protective coating thereon that facilitates handling and fabrication of magnets and also limits grain growth beyond the particle boundaries during the consolidation/annealing step.

In an exemplary working embodiment of the invention to make rare earth-iron-boron alloy isotropic permanent magnet compacts, a melt of the rare earth-iron-boron alloy is high pressure inert gas atomized to provide a batch of particles in an environmentally stable form (e.g., protectively coated) wherein a majority of the particles in the batch are less than about 44 microns in diameter, preferably in the range of about 5 to 40 microns, to achieve optimum, as-atomized magnetic properties (e.g., maximum energy product of about 9-10 MGOe in the as-atomized condition). The alloy composition is preferably enriched in rare earth and boron to promote formation of particles having an equiaxed, blocky microstructure with a large volume percentage of the hard magnetic phase ($Nd_2Fe_{14}B$) while substantially avoiding formation of the ferritic iron (Fe) phase.

Following a preliminary screening operation to substantially remove particles greater than about 44 microns diameter from the particle batch, the remaining portion of the particles (i.e., less than about 44 microns diameter) are hot isostatically pressed at a temperature of at least about 600° C. and pressure of at least about 20 ksi for a time to produce a densified magnet compact having improved magnetic properties as compared to the as-atomized particle magnetic properties and significantly enhanced mechanical properties as compared to other Nd—Fe—B magnet compacts heretofore available. The method of the invention combines the heretofore separate particulate consolidation and annealing steps into a single, shorter duration step that avoids partial particle melting and grain growth and also yields a permanent magnet compact having improved homogeneity of microstructures and composition.

The method of the invention can be used to economically produce isotropic permanent magnet compacts of desired microstructure and desired magnetic properties, such as energy products in the range of about 4 to about 10 MGOe. Isotropic permanent magnet compacts having transverse rupture strength of at least about 200 MPa are provided.

BRIEF DESCRIPTION OF THE DRAWINGS

FIG. 5 is a bar graph illustrating the distribution in weight % of particles as a function of particle size (diameter).

FIG. 8 is a bar graph for Nd—Fe—B alloy particles illustrating particle grain size as a function of particle size.

DETAILED DESCRIPTION OF THE INVENTION

Figure 1:
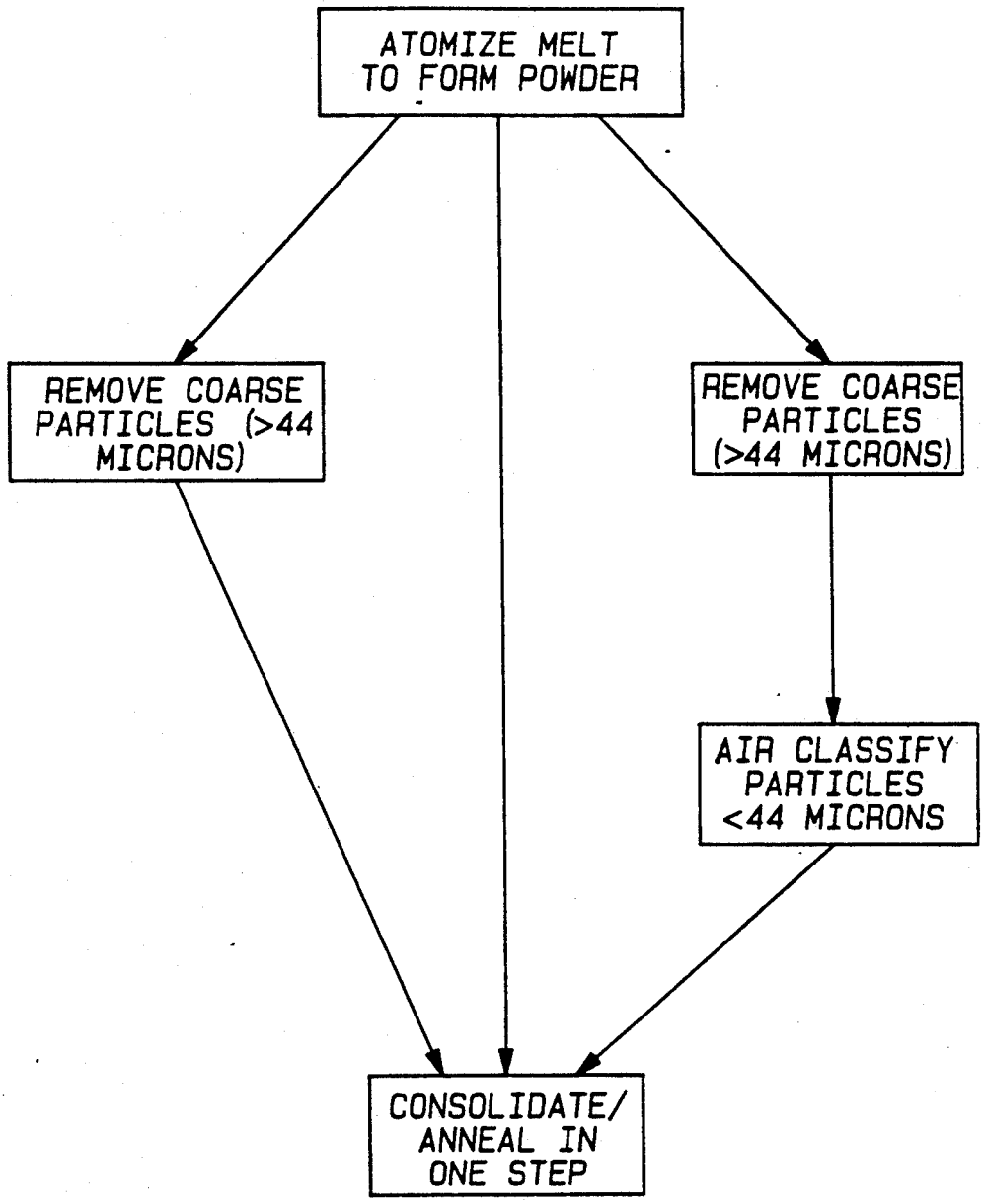
FIG. 1 is a flow sheet illustrating the sequential method steps of one embodiment of the invention.

Referring to FIG. 1, the various steps involved in practicing one particular embodiment of the method of the invention are illustrated. In this particular embodiment of the invention, a melt of the appropriate rare earth-transition metal alloy is atomized by a high pressure inert gas atomization process of the type described in copending commonly assigned U.S. Pat. application Ser. No. 594,088 (Attorney Docket No. 1250) entitled "Environmentally Stable Reactive Alloy Powders And Method Of Making Same", to produce fine, environmentally stable, generally spherical, rapidly solidified powder particles of the rare earth-transition metal alloy. The rapid solidification rate that is achieved during this inert gas atomization process is similar to that achieved in melt spinning in so far as there is a beneficial reduction in alloy constituent segregation during freezing, particularly as compared to the coarse segregation patterns evident in chill cast ingots.

Figure 2:
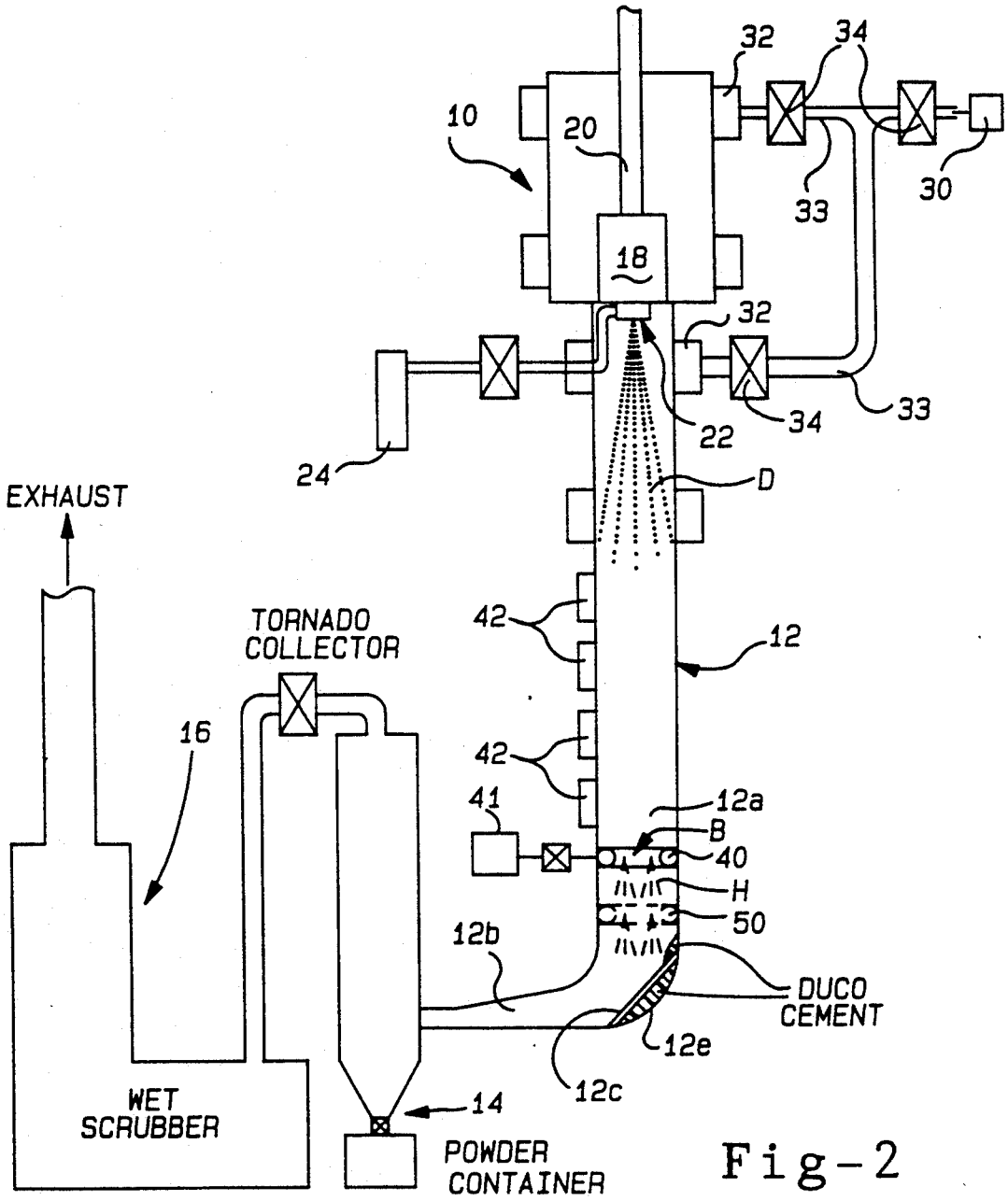
FIG. 2 is a schematic view of apparatus for practicing one embodiment of the invention.

Referring to FIG. 2, a gas atomization apparatus is shown for atomizing the melt in accordance with the aforementioned high pressure inert gas atomization process. The apparatus includes a melting chamber 10, a drop tube 12 beneath the melting chamber, a powder separator/collection chamber 14 and a gas exhaust cleaning system 16. The melting chamber 10 includes an induction melting furnace 18 and a vertically movable stopper rod 20 for controlling flow of melt from the furnace 18 to a melt atomizing nozzle 22 disposed between the furnace and the drop tube. The atomizing nozzle 22 preferably is of the general supersonic inert gas type described in the Ayers and Anderson U.S. Pat. No. 4,619,845, the teachings of which are incorporated herein by reference, as-modified in the manner described in Example 1. The atomizing nozzle 22 is supplied with an inert atomizing gas (e.g., argon, helium) from a suitable source 24, such as a conventional bottle or cylinder of the appropriate gas. As shown in FIG. 2, the atomizing nozzle 22 atomizes the melt in the form of a spray of generally spherical, molten droplets D discharged into the drop tube 12.

Both the melting chamber 10 and the drop tube 12 are connected to an evacuation device (e.g., vacuum pump) 30 via suitable ports 32 and conduits 33. Prior to melting and atomization of the melt, the melting chamber 10 and the drop tube 12 are evacuated to a level of $10^{-4}$ atmosphere to substantially remove ambient air. Then, the evacuation system is isolated from the chamber 10 and the drop tube 12 via the valves 34 shown and the chamber 10 and drop tube 12 are positively pressurized by an inert gas (e.g., argon to about 1.1 atmosphere) to prevent entry of ambient air thereafter.

The drop tube 12 includes a vertical drop tube section **12*a* and a lateral section 12*b* that communicates with the powder collection chamber 14. The drop tube vertical section 12*a* has a generally circular cross-section having a diameter in the range of 1 to 3 feet, a diameter of 1 foot being used in the examples set forth below. As will be explained below, the diameter of the drop tube section 12*a* and the diameter of the supplemental reactive gas jet 40 are selected in relation to one another to provide a reactive gas zone or halo H extending substantially across the cross-section of the drop tube vertical section 12*a*** at the zone H.

The length of the vertical drop tube section **12*a* is typically about 9 to about 16 feet, a preferred length being 9 feet being used in the examples set forth below, although other lengths can be used in practicing the invention. A plurality of temperature sensing means 42 (shown schematically), such as radiometers or laser doppler velocimetry devices, may be spaced axially apart along the length of the vertical drop section 12*a*** to measure the temperature of the atomized droplets D as they fall through the drop tube and cool in temperature.

The supplemental reactive gas jet 40 referred to above is disposed at location along the length of the vertical drop section **12*a*** where the falling atomized droplets D have cooled to a reduced temperature (compared to the droplet melting temperature) at which the droplets have at least a solidified exterior surface thereon and at which the reactive gas in the zone H can react with one or more reactive alloying elements of the shell to form a protective barrier layer (reaction product layer comprising a refractory compound of the reactive alloying element) on the droplets whose depth of penetration into the droplets is controllably limited by the presence of the solidified surface as will be described below.

In particular, the jet 40 is supplied with reactive gas (e.g., nitrogen) from a suitable source 41, such as a conventional bottle or cylinder of appropriate gas, through a valve and discharges the reactive gas in a downward direction into the drop tube to establish the zone or halo H of reactive gas through which the droplets travel and come in contact for reaction in-situ therewith as they fall through the drop tube. The reactive gas is preferably discharged downwardly in the drop tube to minimize gas updrift in the drop tube 12. The flow patterns established in the drop tube by the atomization and falling of the droplets inherently oppose updrift of the reactive gas. As a result, a reactive gas zone or halo H having a more or less distinct upper boundary B and less distinct lower boundary extending to the collection chamber 14 is established in the drop tube section **12*a* downstream from the atomizing nozzle in FIG. 1. As mentioned above, the diameter of the drop tube section 12*a* and the jet 40** are selected in relation to one another to establish a reactive gas zone or halo that extends laterally across the entire drop tube cross-section. This places the zone H in the path of the falling droplets D so that substantially all of the droplets travel therethrough and contact the reactive gas.

The temperature of the droplets D as they reach the reactive gas zone H will be low enough to form at least a solidified exterior surface thereon and yet sufficiently high as to effect the desired reaction between the reactive gas and the reactive alloying element(s) of the droplet composition. The particular temperature at which the droplets have at least a solidified exterior shell will depend on the particular melt composition, the initial melt superheat temperature, the cooling rate in the drop tube, and the size of the droplets as well as other factors such as the "cleanliness" of the droplets; i.e., the concentration and potency of heterogeneous catalysts for droplet solidification.

Preferably, the temperature of the droplets when they reach the reactive gas zone H will be low enough to form at least a solidified exterior skin or shell of a detectable, finite shell thickness; e.g., a shell thickness of at least about 0.5 micron. Even more preferably, the droplets are solidified from the exterior surface substantially to the droplet core (i.e., substantially through their diametral cross-section) when they reach the reactive gas zone H. As mentioned above, radiometers or laser doppler velocimetry devices, may be spaced axially apart along the length of the vertical drop section **12*a* to measure the temperature of the atomized droplets D as they fall through the drop tube and cool in temperature, thereby sensing or detecting when at least a solidified exterior shell of finite thickness has formed on the droplets. The formation of a finite solid shell on the droplets can also be readily determined using a physical sampling technique in conjunction with macroscopic and microscopic examination of the powder samples taken at different axial locations downstream from the atomizing nozzle in the drop tube 12**. This technique is disclosed in aforementioned copending U.S. patent application Ser. No. 594,088.

Referring to FIG. 2, prior to atomization, a thermally decomposable organic material is deposited on a splash member **12*c* disposed at the junction of the drop tube vertical section 12*a* and lateral section 12*b* to provide sufficient gaseous carbonaceous material in the drop tube sections 12*a*,12*b* below zone H as to form a carbon-bearing (e.g., graphite) layer on the hot droplets D after they pass through the reactive gas zone H. The organic material may comprise an organic cement to hold the splash member 12*c* in place in the drop tube 12. Alternately, the organic material may simply be deposited on the upper surface or lower surface of the splash member 12*c*. In any event, the material is heated during atomization to thermally decompose it and release gaseous carbonaceous material into the drop tube sections 12*a*,12*b* below zone H. An exemplary organic material for use comprises Duco® model cement that is applied in a uniform, close pattern to the bottom of the splash member 12*c* to fasten it to the elbow 12*e*. Also, the Duco cement is applied as a heavy bead along the exposed uppermost edge of the splash member 12*c* after the initial fastening to the elbow. The Duco organic cement is subjected during atomization of the melt to temperatures of at least 500° C. so that the cement is thermally decomposed and acts as a source of gaseous carbonaceous material to be released into the drop tube sections 12*a*,12*b* beneath the Zone H. The extent of heating and thermal decomposition of the cement and, hence, the concentration of carbonaceous gas available for powder coating is controlled by the position of the splash member 12c, particularly the exposed upper most edge, relative to the initial melt splash impact region and the central zone of the spray pattern. To maximize the extent of heating and thermal decomposition, additional Duco cement can be laid down (deposited) as stripes on the upper surface of the splash member 12c**.

Alternately, a second supplemental jet 50 can be disposed downstream of the first supplemental reactive gas jet 40. The second jet 50 is provided to receive a carbonaceous material, such as methane, argon laced with paraffin oil and the like from a suitable source (not shown), for discharge into the drop tube section 12a to form the carbon-bearing (e.g., graphitic carbon) coating or layer on the hot droplets D after they pass through the reactive gas zone H.

Powder collection is accomplished by separation of the powder particles/gas exhaust stream in the tornado centrifugal dust separator/collection chamber 14 and by retention of separated powder particles in the valved particle-receiving container, FIG. 2.

In practicing the present invention using the apparatus of FIG. 2, the melt may comprise various rare earth-transition metal alloys selected to achieve desired isotropic magnetic properties. The rare earth-transition metal alloys typically include those described in the U.S. Pat. Nos. 4,402,770; 4,533,408; 4,597,938 and 4,802,931, the teachings of which are incorporated herein by reference, where the rare earth is selected from one or more Nd, Pr, La, Tb, Dy, Sm, Ho, Ce, Eu, Gd, Er, Tm, Yb, Lu, Y and Sc. Lower weight lanthanides (Nd, Pr, La, Sm, Ce, Y, Sc) are preferred. Rare earth-iron-boron alloys, especially Nd—Fe—B alloys comprising about 26 to 36 weight % Nd, about 62 to 68 weight % Fe and about 0.8 to 1.6 weight % B, are useful in practicing the invention as a result of their demonstrated excellent magnetic properties.

Nd—Fe—B alloys rich in Nd (i.e., at least about 27 weight %) and rich in B (i.e., at least about 1.1 weight %) are preferred to promote formation of the hard magnetic phase, $Nd_2Fe_{14}B$, in an equiaxed, blocky microstructure, and minimize, preferably avoid, formation of the ferritic Fe phase in all particle sizes produced. The Nd—Fe—B alloys rich in Nd and B were found to be substantially free of primary ferritic Fe phase, which was observed in some particle sizes (e.g., 10 to 20 microns) for Fe rich and near-stoichiometric alloy compositions. Alloyants such as Co, Ga, La and others may be included in the alloy composition, such as 31.5 weight % Nd- 65.5 weight % Fe- 1.408 weight % B- 1.592 weight % La and 32.6 weight % Nd- 50.94 weight % Fe- 14.1 weight % Co- 1.22 weight % B- 1.05 weight % Ga.

In the case of the rare earth-transition metal-boron alloys, the rare earth and boron are reactive alloying elements that must be maintained at prescribed concentrations to provide desired magnetic properties in the powder product.

The reactive gas may comprise a nitrogen bearing gas, oxygen bearing gas, carbon bearing gas and the like that will form a stable reaction product comprising a refractory compound, particularly an environmentally protective barrier layer, with the reactive alloying element of the melt composition. Illustrative of stable refractory reaction products are nitrides, oxides, carbides, borides and the like. The particular reaction product formed will depend on the composition of the melt, the reactive gas composition as well as the reaction conditions existing at the reactive gas zone H. The protective barrier (reaction product) layer is selected to provide protection against environmental constituents, such as air and water in the vapor or liquid form, to which the powder product will be exposed during particle size classifying operations, during subsequent fabrication to an end-use shape, and during use in the intended service application.

The depth of penetration of the reaction product layer into the droplets is controllably limited by the droplet temperature (extent of exterior shell solidification) and by the reaction conditions established at the reactive gas zone H. In particular, the penetration of the reaction product layer (i.e., the reactive gas species, for example, nitrogen) into the droplets is limited by the presence of the solidified exterior shell so as to avoid selective removal of the reactive alloying element (by excess reaction therewith) from the droplet core composition to a harmful level (i.e., outside the preselected final end-use concentration limits) that could substantially degrade the end-use properties of the powder product. For example, with respect to the rare earth-transition metal-boron alloys, the penetration of the reaction product layer is limited to avoid selectively removing the rare earth and the boron alloyants from the droplet core composition to a harmful level (outside the prescribed final end-use concentrations therefor) that would substantially degrade the magnetic properties of the powder product in magnet applications. The thickness of the reaction product layer formed on rare earth-transition metal-boron alloy powder is limited so as not to exceed about 500 angstroms, preferably being in the range of about 200 to about 300 angstroms, for powder particle sizes in the range of about 1 to about 75 microns, regardless of the type of reaction product layer formed. Generally, the thickness of the reaction product layer does not exceed 5% of the major coated powder particle dimension (i.e., the particle diameter) to this end.

The reaction barrier (reaction product) layer may comprise multiple layers of different composition, such as an inner nitride layer formed on the droplet core and an outer oxide type layer formed on the inner layer. The types of reaction product layers formed again will depend upon the melt composition and the reaction conditions present at the reactive gas zone H.

As mentioned above, a carbon-bearing (graphite) layer may be formed in-situ on the reaction product layer by various techniques. Such a layer is formed to a thickness of at least about 1 monolayer (2.5 angstroms) regardless of the technique employed. The carbon-bearing layer provides protection to the powder product against such environmental constituents as liquid water or water vapor as, for example, is present in humid air.

The invention is not limited to the particular high pressure inert gas atomization process described in the patent and may be practiced using other atomization nozzles, such as annular slit nozzles, close coupled nozzles or conventional free-falling nozzles that yield rapidly solidified powder having appropriate sizes for use in the fabrication of isotropic permanent magnets.

Referring to FIG. 1, one embodiment of the invention involves producing environmentally stable, generally spherical, rapidly solidified powder particles using the high pressure inert gas atomization process/apparatus described in Example 1 such that the rare earth-transition metal alloy particles fall within a given particle size (diameter) range (and thus within a given grain size range) wherein the majority of the particles exhibit particle diameters less than a given diameter determined to exhibit desirable magnetic properties for the particular alloy composition and magnet service application involved. For example, in practicing the invention to make Nd—Fe—B alloy magnets, the powder particles produced using the high pressure inert gas atomization process/apparatus typically fall within a particle size (diameter) range of about 1 micron to about 100 microns with a majority (e.g., 66%–68% by weight) of the particles having a diameter less than about 44 microns, typically from about 3 to about 44 microns. Preferably, a majority of the particles are less than about 38 microns in diameter, a particle size found to yield optimum magnetic properties in the as-atomized condition as will become apparent below. FIG. 5 illustrates in bar graph form a typical distribution in weight % of two batches of Nd—Fe—B-La alloy particles as a function of particle size. The composition (in weight %) of the alloys before atomization is set forth below in the Table:

TABLE

| | Nd | Fe | B | La |
|---|---|---|---|---|
| Alloy BT-1-190 | 31.51 | 65.49 | 1.32 | 1.597 |
| Alloy BT-1-216 | 33.07 | 63.93 | 1.32 | 1.68 |

Both alloys BT-1-190 and BT-1-216 were atomized under like conditions similar to those set forth in Example 1. With Nd—Fe—B type alloys, the Nd content of the alloy was observed to be decreased by about 1–2 weight in the atomized powder compared to the melt as a result of melting and atomization, probably due to reaction of the Nd during melting with residual oxygen and formation of a moderate slag layer on the melt surface. The iron content of the powder increased relatively as a result while the B content remained generally the same. The initial melt composition can be adjusted to accommodate these effects.

FIG. 5 reveals that a majority of the as-atomized powder particles fall in the particle size (diameter) range of less than 45 microns, even more particularly less than 38 microns (i.e., −38 on the abscissa). In particular, greater than 60% (about 66%–68%)by weight of the particles exhibit particle diameter of less than 38 microns found to exhibit optimum magnetic properties in the as-atomized condition as will become apparent. These weight distributions were determined by hand sifting (screening) an entire batch of powder through a full range of ASTM woven wire screens and by an automated size analysis technique based on laserlight scattering by an ensemble of particles dispersed in a transparent fluid.

Figure 6:
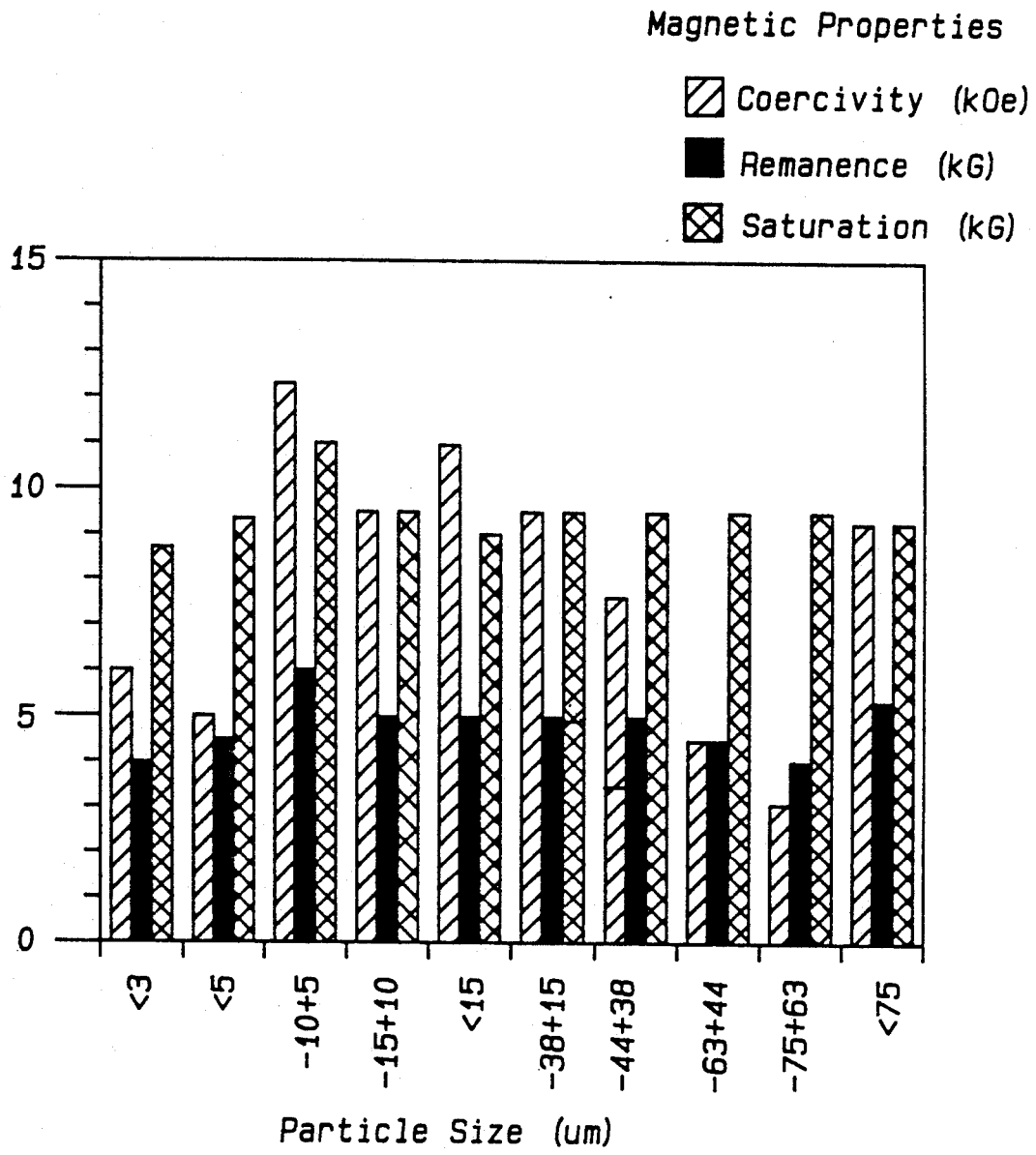
FIG. 6 is a bar graph illustrating the magnetic properties of as-atomized Nd—Fe—B alloy particles as a function of particle size.
Figure 7:
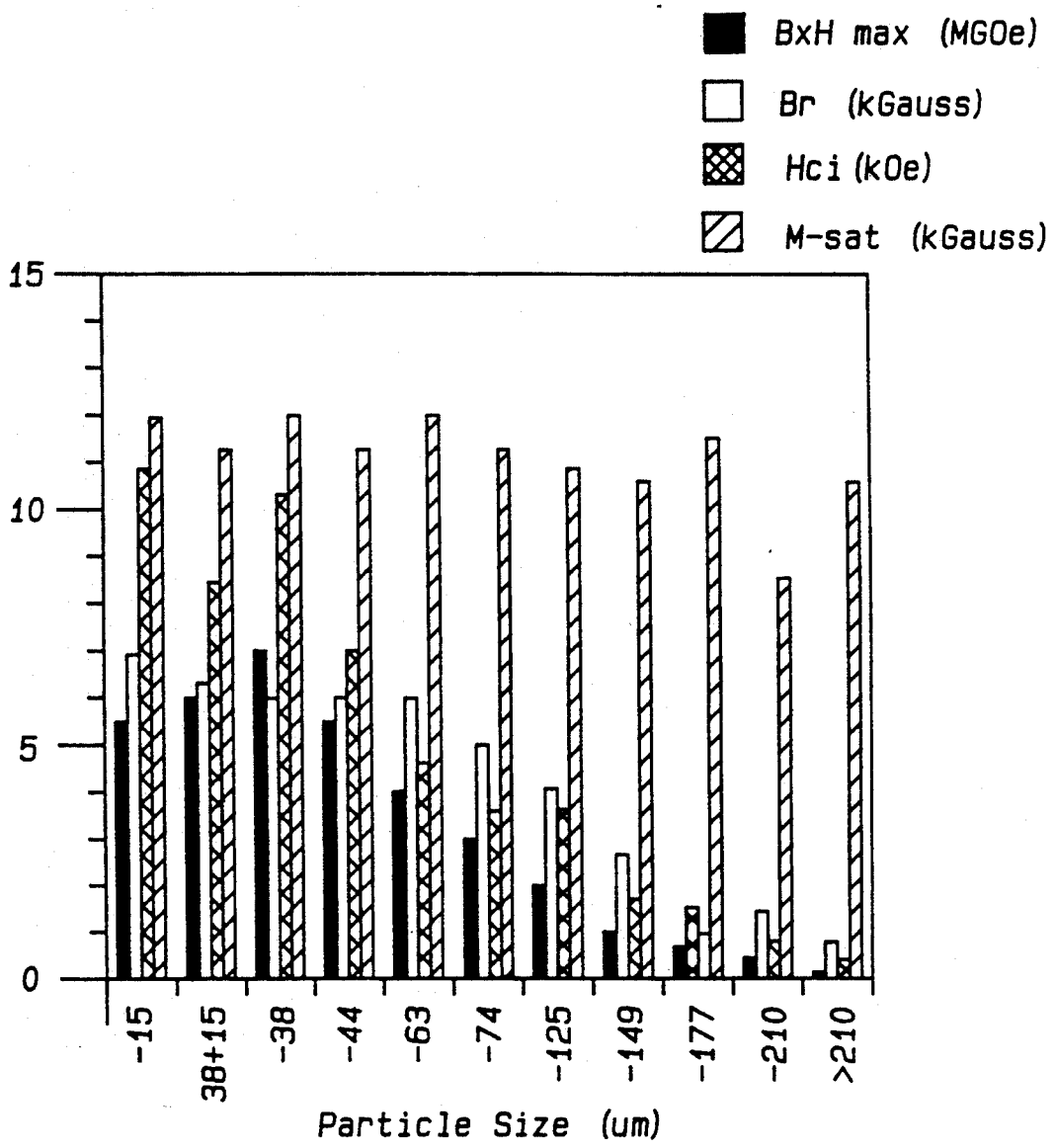
FIG. 7 is a similar bar graph for Nd—Fe—B—La alloy particles.

The advantage of producing the alloy powder particles in the manner described above is evident in FIGS. 6 and 7. In FIGS. 6 and 7, the magnetic properties (namely, coercivity, remanence and saturation) of as-atomized powder as a function of particle size is set forth for alloy BT-1-162 (32.5 weight % Nd-66.2 weight % Fe-1.32 weight % B, FIG. 6) and the aforementioned alloy BT-1-190 (FIG. 7). The alloys were atomized under like conditions similar to those set forth in Example 1. The figures demonstrate that coercivity and, to a lesser extent, remanenoe appear to vary as a function of particle size in both alloys. Elevated levels of coercivity and remanence are observed in both alloys as particle size (diameter) is reduced below about 38 microns. On the other hand, saturation magnetization of both alloys remains relatively constant over the range of particle sizes. For alloy BT-1-162, the coercivity falls significantly as particle size is reduced below about 5 microns. These results correlate with grain size measurements which reveal a continuous decrease in grain size with reduced particle size; e.g., from a grain size of about 500 nm for 15–38 micron particles to about 40–70 nm for less than 5 micron particles; for example, as shown in FIG. 8 for Alloy BT-1-162. Magnetic property differences between powder size classes were due to differences in the microcrystalline grain size within each particle.

From FIGS. 6 and 7, it is apparent that the magnetic properties, particularly the coercivity, of the alloy powder increase with decreased particle size to a maximum of about 10–11 Koe for powder particles of about 15–38 microns diameter, and then decrease for particles of further reduced size. Moreover, it is apparent that near optimum overall magnetic properties are exhibited by the as-atomized alloy particles in the general particle size (diameter) range of about 3 microns to about 44 microns and, more particularly, about 5 to about 40 microns where the majority of the particles are produced by the high pressure inert gas atomization process described above. Thus, the yield of as-atomized powder particles possessing useful magnetic properties is significantly enhanced in practicing the invention as described above.

Typically, in the above-described embodiment of the invention, each batch of alloy particles produced using the high pressure inert gas atomization process of Example 1 is initially size classified by, for example, sifting (screening) through an ASTM 44 micron woven wire mesh screen. This preliminary size classifying operation substantially removes particles greater than 44 microns diameter from the batch and thereby increases the percentage of finer particles in each batch. This preliminary screening operation is conducted in a controlled atmosphere (nitrogen) glove box after the contents of the sealed powder container, FIG. 2, are opened in the glove box.

The remaining alloy particles having particle sizes less than 44 microns diameter can then be further processed (i.e., hot isostatically pressed) in accordance with the invention in a manner to be described below.

Those skilled in the art will appreciate that the initial size classifying (screening) operation may be employed using other than the aforementioned 44 micron woven wire screen depending upon the particular alloy involved and the variation of magnetic properties of the as-atomized alloy particles as a function of particle size. In particular, an appropriate screen size can be used for each batch of alloy particles to remove particles greater than the given size range exhibiting near optimum magnetic properties, thereby increasing the weight percentage of particles in each batch having particle sizes below the given size.

Referring to FIG. 1, in another embodiment of the invention, the generally spherical, rapidly solidified powder produced by the high pressure inert gas atomization process is subjected to the preliminary size classifying (screening) operation described above and also to one or more additional size classifying operations to form multiple particle size fractions or classes wherein each fraction or class comprises powder particles having a particle size (diameter) range in a given relatively narrow range. For example, for a typical batch of high pressure inert gas atomized Nd—Fe—B powder (e.g., BT--1-162 described above), the following particle size fractions or classes having the listed range of particle sizes (diameters) are provided by carrying out an air classifying operation on the batch:

Fraction #1—about 15 to about 38 microns (diameter)
Fraction #2—about 10 to about 15 microns (diameter)
Fraction #3—about 5 to about 10 microns (diameter)
Fraction #4—about 3 to about 5 microns (diameter)

In particular, the rapidly solidified powder particles were air classified using a commercially available air classifier sold as model A-12 under the name Majac Acucut air classifier by Hosokawa Micon International Inc., 10 Chantham Rd., Summit, N.J. The air classifier was operated at a blower pressure of 13.5 inch water, an ejector pressure of 50 psi with rotor speeds of 507 rpm, 715 rpm, 1145 rpm, and 1700 rpm to produce the particle size fractions #1, #2, #3 and #4, respectively.

As is apparent, in any given particle size fraction or class, the powder particles fall within a given narrow range of particle sizes (diameters). As a result, the powder particles in each particle size fraction or class exhibit a rapidly solidified microstructure, especially grain size, also within a very narrow range and provide isotropic magnetic properties upon consolidation/annealing in accordance with the next step of the invention. For example the following grain size ranges were observed for each particle size fraction:

Fraction #1—about 490 nm to about 500 nm grain size
Fraction #2—about 210 nm to about 220 nm grain size
Fraction #3—about 115 nm to about 130 nm grain size
Fraction #4—about 60 nm to about 75 nm grain size A plurality of particle size fractions or classes having quite uniform particle microstructures (grain sizes) within each fraction or class are thereby provided by the size (air) classifying operation depicted in FIG. 1. Depending upon the particular magnetic properties desired in the magnet, a particular particle size fraction or class having the appropriate microstructure can then be selected to this end for further processing in accordance with the invention to produce the desired magnet. A different particle size fraction or class can be chosen for further processing in accordance with the invention in the event slightly different magnetic/mechanical properties are specified by the magnet user or manufacturer.

Referring again to FIG. 1, the size classified powder particles, either as initially size classified (screened) in accordance with the first embodiment of the invention, as air classified in accordance with the second embodiment of the invention or as-atomized, are subjected to a combined consolidation and annealing step using an elevated temperature and elevated isotropic pressure for a time to densify the powder particles to a desired magnet body or compact configuration and enhance the magnetic and mechanical properties. Generally, the magnet compacts resulting from the combined consolidation/annealing operation will exhibit a density between 85% and 99%, preferably 100%, of theoretical, although the invention is not limited to any particular density. The isotropic magnetic properties achieved will depend upon the particular rare earth-transition alloy composition, the selected particle size (grain size) and the hot isostatic pressing cycle conditions, such as temperature, pressure and cycle time. Use of the alloy particles having generally uniform particle size and thus microstructures as-atomized and screened and/or air classified yields a compact having isotropic magnetic properties after the consolidation/annealing step. Moreover, the magnetic properties of body or compact will improve beyond those exhibited by the as-atomized alloy particles. For example, referring to FIG. 9, the magnetic properties of as-atomized alloy BT-1-174 (34.7 weight % Nd-63.89 weight % Fe-1.31 weight % B) as atomized and after hot isostatic pressing for different times at 700° C. and 300 MPa (44 ksi) are shown. The magnetic properties of as-atomized particles were determined on appropriate samples wherein the particles were bonded in epoxy. A SQUID magnetometer (saturation field strength of 4.5 Tesla) was used to measure magnetic properties at ambient temperature.

Figure 9:
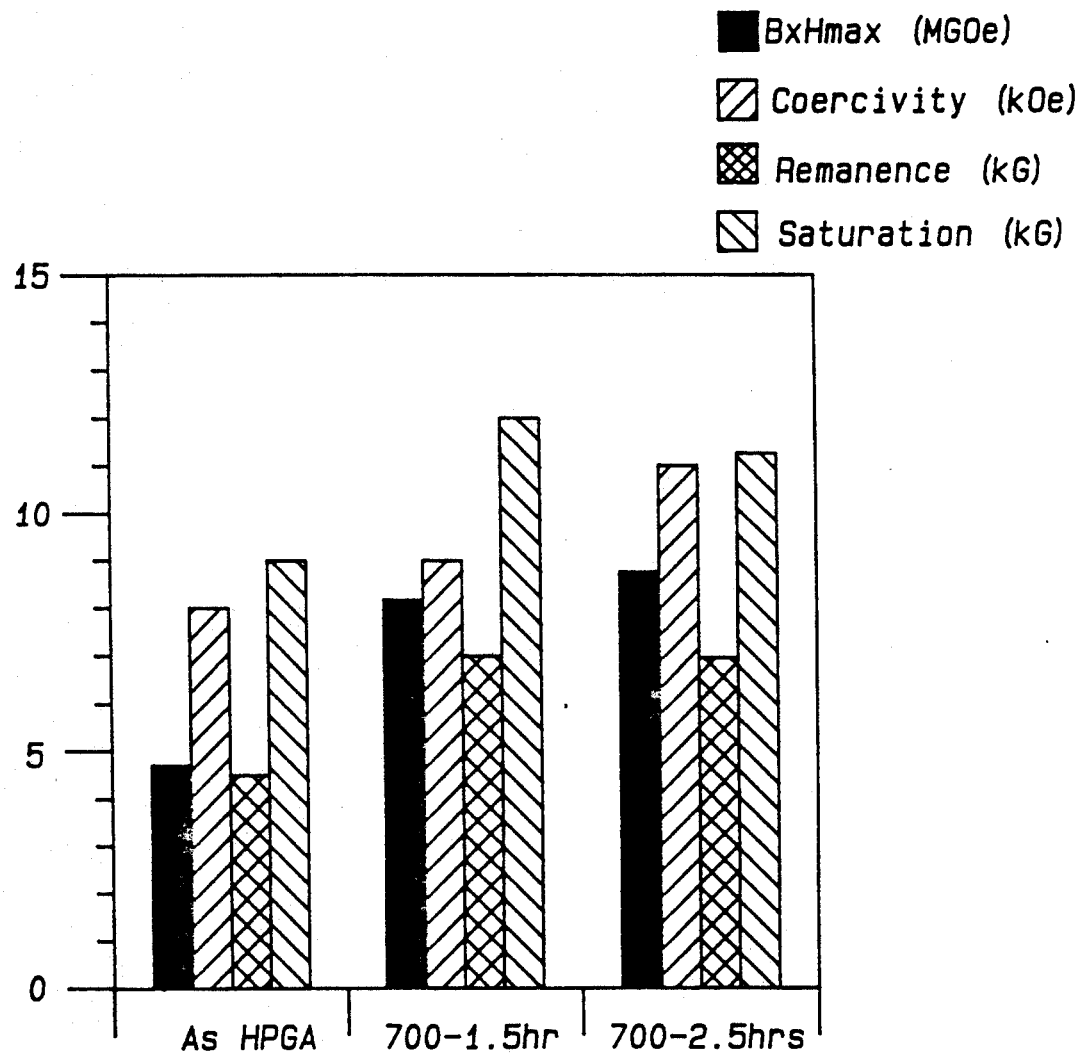
FIG. 9 is a bar graph illustrating the magnetic properties of alloy particles as-atomized and as-HIP'ed for different times.
Figure 10:
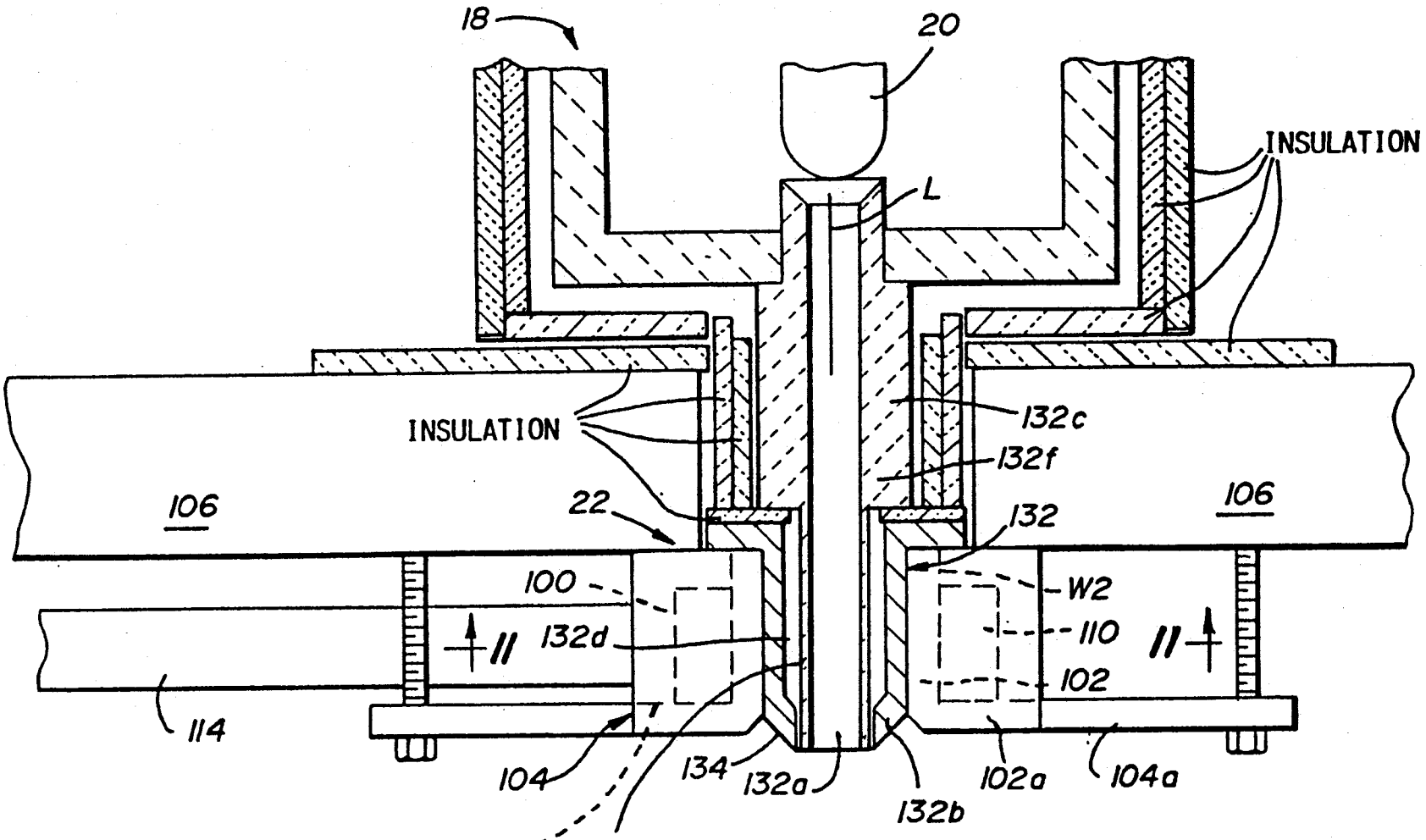
FIG. 10 is a side elevation of a modified atomizing nozzle used in the examples.
Figure 11:
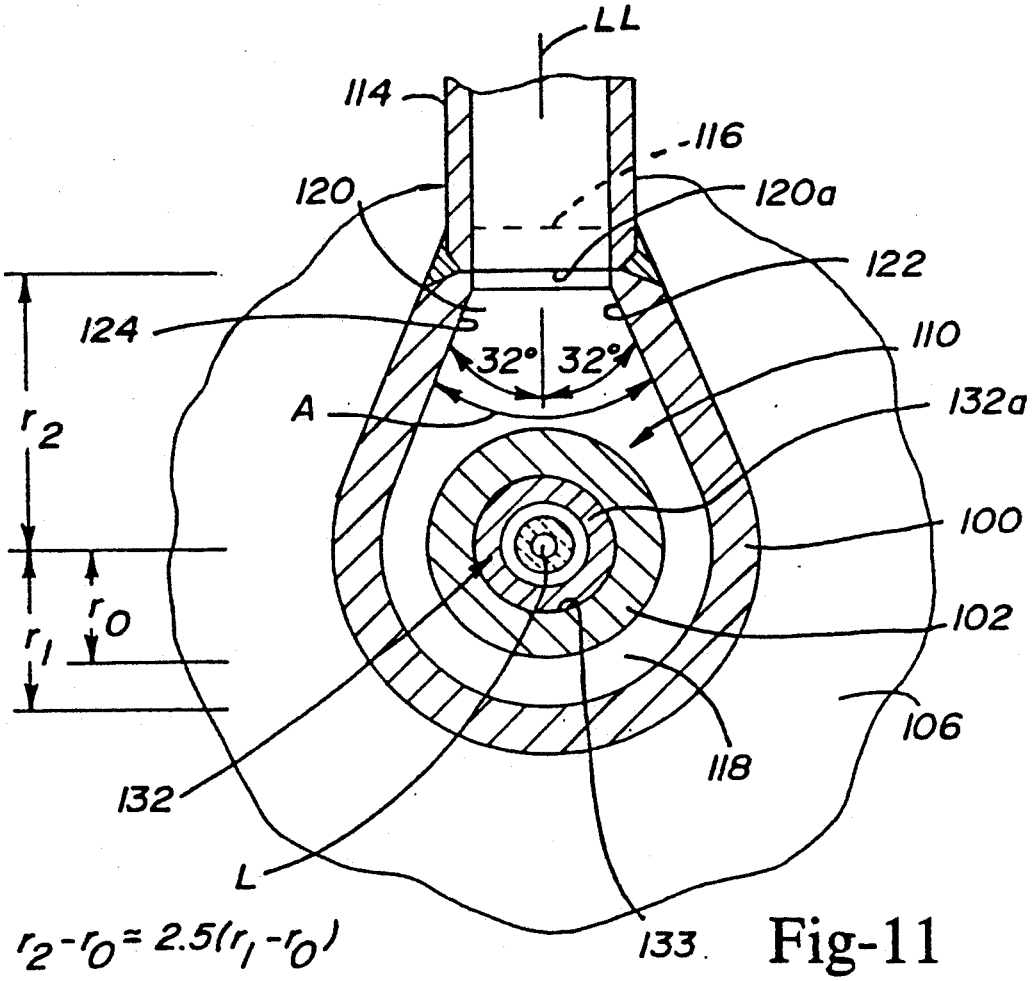
FIG. 11 is a sectional view of a modified atomizing nozzle along lines 11—11.
Figure 13:
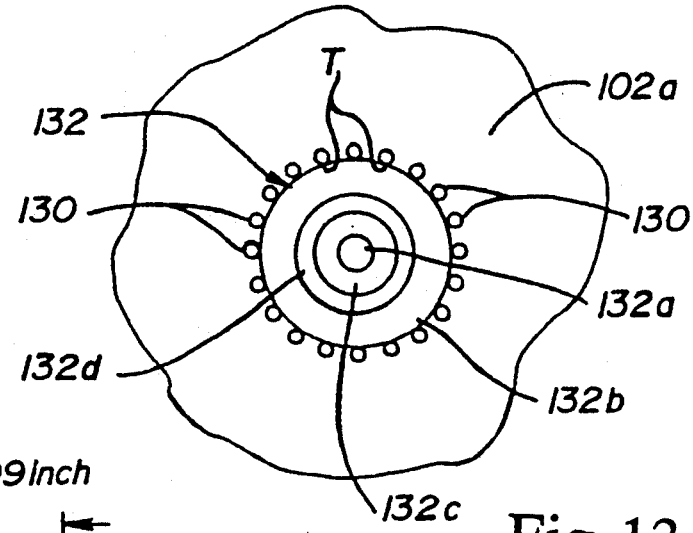
FIG. 13 is a bottom plan view of the modified nozzle.
Figure 12:
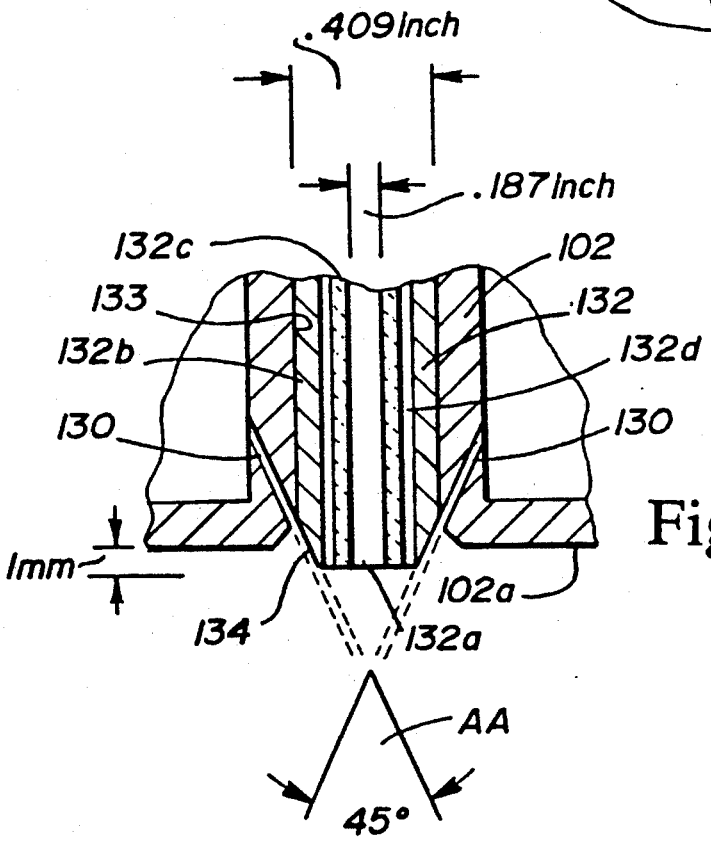
FIG. 12 is a view of the modified atomizing nozzle showing gas jet discharge orifices aligned with the nozzle tube surface.

As is apparent in FIG. 9, HIP processing of the alloy particles notably improved magnetic properties for both HIP times involved. For example, after 1.5 hours, significant increases occurred in intrinsic magnetic saturation and remanence. This might be attributed to the solid state transformation of a metastable phase(s) to the equilibrium hard magnetic phase, $Nd_2Fe_{14}B$, which exhibits higher saturation and remanence. Although only a modest increase in coercivity was observed after 1.5 hours, the total energy product increased about 67%. The 2.5 hour HIP cycle resulted in a further enhancement in coercivity with little further improvement in saturation and remanence. This behavior suggests the growth of the fine, overquenched (120 nm) grains of $Nd_2Fe_{14}B$, to a more optimum size. The total energy product displayed an 83% improvement after the 2.5 HIP cycle compared to as-atomized particles. The improved magnetic properties appear to result from grain growth within the prior particle boundaries to achieve an optimum grain size and magnetic domain distribution. Since the initial grain size of the as-atomized particles is near optimum as a result of the atomizing conditions and screening/air classifying operations, only minor exposure to elevated temperature is required to achieve optimum grain size and can be combined with particle consolidation into a one step treatment in accordance with the invention. The maximum grain size of the densified compact appears to be limited by the environmentally stable particle coating so as not to exceed the dimensions of the prior particle boundaries.

Typically, in conducting the combined consolidation-/annealing step, the powder particles are packed in a suitable container, such as a cleaned, outgassed, end-capped tantalum foil sleeve. The packed tantalum foil sleeve is then placed in an annealed thin wall, copper outer container which is hermetically sealed under vacuum by welding. The container assembly is then subjected to an elevated temperature of at least about 600° C., preferably about 675° to 800° C., and elevated isotropic pressure of at least about 20 ksi, preferably about 25 to about 44 ksi, for a time of at least about 30 minutes, preferably about 60 to about 180 minutes, in the case of the Nd—Fe—B alloy powder described hereinabove. Of course, other temperature and pressure parameters can be used for other rare earth-transition metal alloy particles as necessary to achieve the desired densification and development of magnetic properties for the compact. The powder filled container assembly is typically subjected to the elevated temperature and isotropic pressure in a conventional hot isostatic pressing apparatus.

In practicing the method of the invention, the powder particles are subjected to concurrent consolidation and annealing of the powder particles to develop desired density, improved magnetic properties (intrinsic coercivity, magnetic remanence and maximum energy product) and improved mechanical properties in the compact. The magnet compacts produced exhibit improved homogeneity of microstructure (grain size), composition and properties (magnetic and mechanical) than achievable by the aforementioned prior art fabrication approaches. In addition, as will become evident from the Examples which follow, magnet compacts produced in accordance with the method of the invention exhibit levels of coercivity and energy products competitive with those achieved heretofore by the more complex, time consuming and costly prior art fabrication approaches. Moreover, the mechanical properties of the magnet compacts of the invention are dramatically improved as compared to those produced by the prior art fabrication approaches as a result of the beneficial effect of particle sphericalness on interparticle bonding.

Following the combined consolidation/annealing step, the copper container and tantalum sleeve are removed from the resulting magnet compact by cutting under oil-cooled conditions. The magnet compact can then be subjected to machining or other shaping operations as necessary for the intended service application.

EXAMPLE 1

The melting furnace of FIG. 2 was charged with an Nd-16 weight % Fe master alloy as-prepared by thermite reduction, an Fe—B alloy carbo-thermic processed and obtained from Shieldalloy Metallurgical Corp. and electrolytic Fe obtained from Glidden Co. The quantity of each charge constituent was controlled to provide a melt composition of about 33.0 weight % Nd-65.9 weight % Fe-1.1 weight % B. The charge was melted in the induction melting furnace after the melting chamber and the drop tube were evacuated to $10^{-4}$ atmosphere, and then pressurized with argon to 1.1 atmospheres. The melt was heated to a temperature of 1650° C. After a hold period of 10 minutes to reduce (vaporize) Ca present in the melt (from the thermite reduced Nd—Fe master alloy) to melt levels of 50–60 ppm by weight, the melt was fed to the atomizing nozzle by gravity upon raising the boron nitride stopper rod. The atomizing nozzle was of the type described in U.S. Pat. No. 4,619,845 as modified (see FIGS. 10–13) to include (a) a divergent manifold expansion region 120 between the gas inlet 116 and the arcuate manifold segment 118 and (b) an increased number (i.e., 20) of gas jet discharge orifices 130 that are NC (numerical control) machined to be in close tolerance tangency T (e.g., within 0.002 inch,, preferably 0.001 inch) to the inner bore 133 of the nozzle body 104 to proVide Improved laminar gas flow over the frusto-conical surface 134 of the two-piece nozzle melt tube 132 (i.e., inner boron nitride melt supply tube **132*c* and outer Type 304 stainless steel tube 132*b* with thermal insulating space 132*d* therebetween. The divergent expansion region 120 minimizes wall reflection shock waves as the high pressure gas enters the manifold to avoid formation of standing shock wave patterns in the manifold, thereby maximizing filling of the manifold with gas. The manifold had an $r_0$ of 0.3295 inch, $r_1$ of 0.455 inch and $r_2$ of 0.642 inch. The number of discharge orifices 130 was increased from 18 (patented nozzle) to 20** but the diameter thereof was reduced from 0.0310 inch (patented nozzle) to 0.0292 inch to maintain the same gas exit area as the patented nozzle. The modified atomizing nozzle was found to increase the percentage of particles falling in the desired particle size range (e.g., less than 38 microns) for optimum magnetic properties for the Nd—Fe—B alloy involved from about 25 weight % to about 66–68 weight %. The yield of optimum particle sizes was thereby increased to improve the efficiency of the atomization process. The modified atomizing nozzle is described in copending U.S. patent application entitled "Improved Atomizing Nozzle And Process" Ser. No. 593,942, the teachings of which are incorporated herein by reference.

Argon atomizing gas at 1050 psig was supplied to the atomizing nozzle in accordance with the aforementioned patent. The reactive gas jet was located 75 inches downstream of the atomizing nozzle in the drop tube. Ultra high purity (99.95%) nitrogen gas was supplied to the jet at a pressure of 100 psig for discharge into the drop tube to establish a nitrogen gas reaction zone or halo extending across the drop tube such that substantially all the droplets traveled through the zone. At this downstream location from the atomizing nozzle, the droplets were determined to be at a temperature of approximately 1000° C. or less, where at least a finite thickness solidified exterior shell was present thereon. After the droplets traveled through the reaction zone, they were collected in the collection container of the collection chamber (see FIG. 2). The solidified powder product was removed from the collection chamber when the powder reached approximately 22° C.

The powder particles comprised a core having a particular magnetic end-use composition, an inner protective refractory layer and an outer carbonaceous (graphitic carbon) layer thereon. The refractory layer thickness is limited so as not to exceed about 500 angstroms, preferably being in the range of about 200 to about 300 angstroms. Auger electron spectroscopy (AES) was used to gather surface and near surface chemical composition data on the particles using in-situ ion milling to produce a depth profile. The AES analysis indicated an inner surface layer enriched in nitrogen, boron and Nd corresponding to a mixed Nd-B nitride (refractory reaction product). The first inner layer was about 150 to about 200 angstroms in thickness. A second inner layer enriched in Nd, Fe, and oxygen was detected atop the nitride layer. This second layer corresponded to the mixed oxide of Nd and Fe (refractory reaction product) and is believed to have formed as a result of decomposition and oxidation of the initial nitride layer while the powder particles were still at elevated temperature. The second layer was about 100 angstroms in thickness. An outermost third layer of graphite was also present on the particles. This outermost layer was comprised of graphitic carbon with some traces of oxygen and had a thickness of at least about 3 monolayers. This outermost carbon layer is believed to have formed as a result of thermal decomposition of the Duco® cement (used to hold the splash member **12*c* in place in the drop tube 12**) and subsequent deposition of carbon on the hot particles after they passed through reactive gas zone H so as to produce the graphitic carbon film or layer thereon. Subsequent atomizing runs conducted with and without excess Duco cement present confirmed that the cement was functioning as a source of gaseous carbonaceous material for forming the graphite outer layer on the particles. The Duco cement is typically present in an amount of about one (1) ounce for atomization of a 4.5 kilogram melt to produce the graphite coating on the particles.

The rapidly solidified, spherical Nd—Fe—B powder particles produced in this way exhibited about 100 microns with a majority of the particles being less than about 42 microns in diameter. The powder particles were initially size classified (screened) under a nitrogen atmosphere glove box using an ASTM 44 micron woven wire mesh screen and then air classified into several particle size fractions or classes by using the commercially available air classifier referred to above operated at rotor speeds of 570 rpm, 715 rpm, 1145 rpm, for size fractions #2 to #4, respectively, with a blower pressure at 13.5 inches water and ejector pressure at 50 psi. Particle size fractions or classes were thereby provided wherein the particles of each fraction or class exhibited the following particle sizes (diameters) and grain sizes:

| | Particle Size (Diameter) | Grain Size |
|---|---|---|
| Fraction #1- | 38 to 44 microns | >500 nm |
| Fraction #2- | 15 to 38 microns | 500 nm |
| Fraction #3- | 10 to 15 microns | 215 nm |
| Fraction #4- | 5 to 10 microns | 125 nm |

Figure 3:
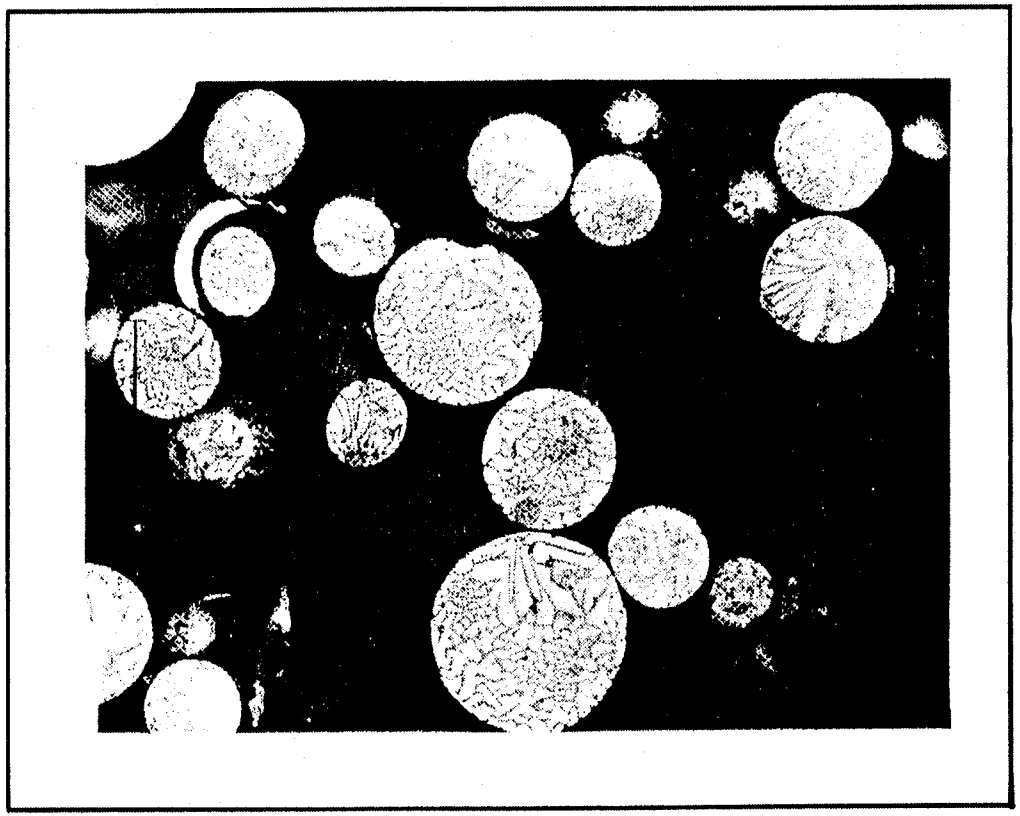
FIG. 3 is a photomicrograph at 1000× of a batch of rapidly solidified powder particles classified into a particle size fraction of less than 38 microns diameter.

Fraction #2 was selected for further processing in accordance with the method of the invention. A portion of the powder particles of this fraction #2 are shown in FIG. 3. In particular, powder particles from fraction #2 were packed into a tantalum foil sleeve (0.010 inch wall thickness). The sleeve had been previously chemically cleaned in a solution of 90 volume % HNO3/10 volume % HF for 10 minutes, washed in water, rinsed in an ultrasonic for 2 hours in a vacuum of $10^{-6}$ torr. The powder filled tantalum foil sleeve was then placed into an annealed thin wall (0.0625 inch wall thickness) copper (grade 101) container of cylindrical shape. The copper container was then hermetically sealed in a vacuum of $10^{-5}$ torr by welding the container closed.

The powder filled container assembly was then subjected to a combined consolidation/annealing operation at 700° C. and isotropic pressure of 44 ksi (303 MPa) in a conventional hot isostatic pressing apparatus for 1.5 hours.

Figure 4:
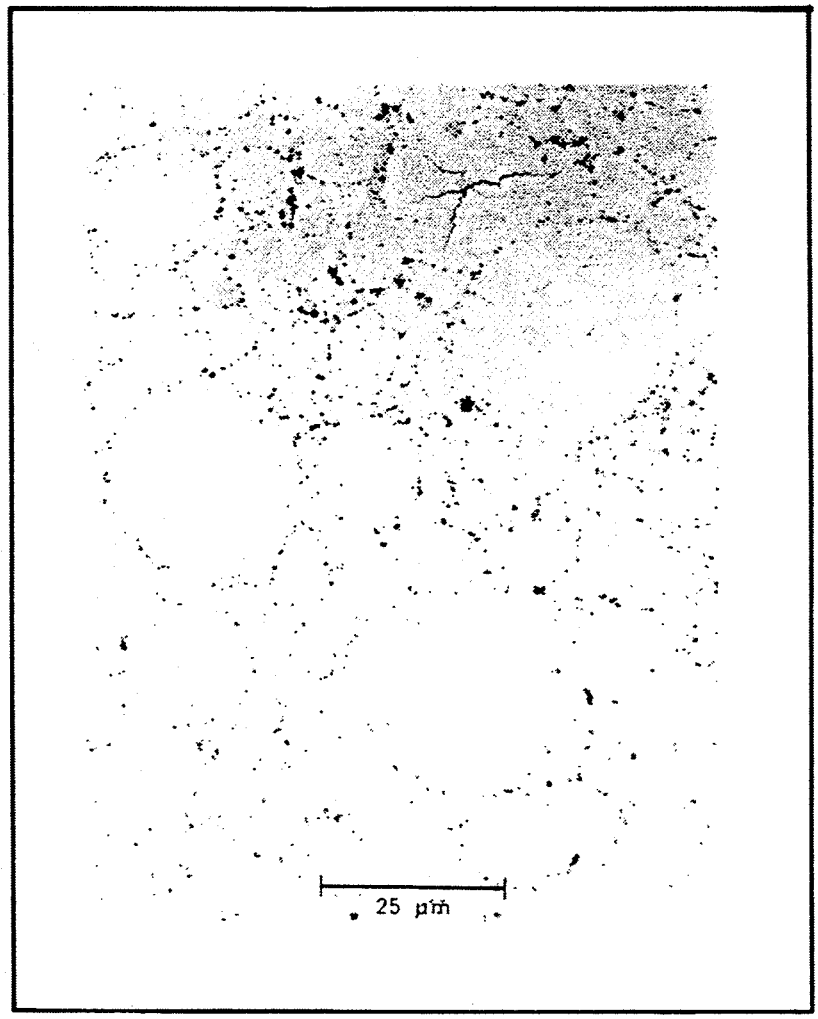
FIG. 4 is a photomicrograph at 1000× of a section of an isotropic permanent magnet made in accordance with Example 1 and exhibiting a homogeneous microstructure and isotropic magnetic properties.

After the consolidation/annealing operation, the container/sleeve were machined off to yield a cylindrical shaped magnet compact. A metallographic section of the resulting magnet compact is shown in FIG. 4 wherein it is apparent that a homogenous microstructure (grain size) is present. A 3/16 inch (4.76 mm) diameter × ¼ inch (6.35 mm) long sample (designated Sample 1) was machined from the resulting magnet compact and was tested in a vibrating sample magnetometer to determine saturation ($M_S$), energy product (BHmax), remanence ($B_r$) and, coercivity (Hci). The measured magnetic properties are shown in Table 1 set forth hereinbelow following the remaining examples.

The following additional samples were made in accordance with the procedures described in Example 1 but using, in some cases, different alloy compositions, particle sizes and hot isostatic pressing conditions as set forth in each following example.

EXAMPLE 2

Particle size fraction #4 of Example 1 was hot isostatically pressed under the same conditions as Example 1 to determine the influence of particle size/grain size on magnetic properties. Sample 2 was prepared from the HIP'ed fraction #4 as set forth in Example 1. From Table II, it is apparent that the particles in the size range 15 to 38 microns exhibited the better magnetic properties.

EXAMPLE 3

A batch of alloy powder particles was produced as in Example 1 from a melt comprising 32.5 weight % Nd-66.2 weight % Fe-1.32 weight % B in a size range of about 1 to about 100 microns diameter with a majority of the particles falling in the particle size range of about 15 to 20 microns diameter. The batch was initially screened using an ASTM 400 mesh woven wire screen to provide particle sizes less than 38 microns. Powder from the screened batch (without further air classification) were hot isostatically pressed at 750° C. and 44 ksi for 1.5 hours. Sample 3 was prepared from the HIP'ed particles as set forth in Example 1.

EXAMPLE 4

A portion of the batch of alloy powder particles of Example 3 was air classified as in Example 1 to below 15 micron diameters. The air classified particles were HIP'ed in the manner set forth in Example 3. Sample 4 was prepared from the HIP'ed particles as set forth in Example 1. The resulting magnetic properties were lower for the finer-sized particles having the finer grain size.

EXAMPLE 5

Alloy powder was atomized from a melt comprising 34.7 weight %Nd-63.89 weight % Fe-1.31 weight % B (i.e., enriched in rare earth and boron), air classified to 15 to 38 micron diameters and HIP'ed in a manner similar to Example 1. Sample 5 was prepared from the HIP'ed particles as set forth in Example 1. Excellent magnetic properties were observed.

EXAMPLE 6

The procedures of Example 5 were repeated to produce Sample 6 determine reproducibility of the process.

EXAMPLE 7

The procedures of Example 5 were repeated except that the HIP time was increased to 2.5 hours. Sample 7 was prepared from the HIP'ed particles as set forth in Example 1. Sample 7 shows increased coercivity with the longer HIP time.

TABLE I

Magnetic Performance of HPGA Powders and Consolidated Samples

| Sample | Saturation (kGauss) | BHmax (MGOe) | Remanence (kGauss) | Coercivity (kOe) |
|---|---|---|---|---|
| 1. | 12.4 | 10.0 | 6.9 | 10.0 |
| 2. | 12.4 | 5.0 | 6.3 | 5.5 |
| 3. | 12.0 | 6.9 | 6.3 | 7.5 |
| 4. | 9.5 | 4.6 | 5.2 | 7.2 |
| 5. | 11.9 | 8.0 | 6.5 | 9.0 |
| 6. | 12.2 | 7.8 | 6.5 | 9.0 |
| 7. | 11.73 | 8.8 | 6.6 | 11.5 |

The magnetic properties set forth in Table 1 illustrate that the method of the invention produced isotropic permanent magnets exhibiting a range of moderate levels of coercivity and other magnetic properties competitive with those exhibited by commercially available magnets produced by the aforementioned prior art approaches which are more time consuming, complex and costly. The magnetic properties set forth in Table 1 were isotropic for each compact produced.

The mechanical properties of the magnet compacts of the invention are isotropic and dramatically superior to those achievable by the aforementioned prior art approaches. For example, the transverse rupture strength of magnet compacts of the invention was determined using the known three point bend test method (ASTM B528-76). The magnet compacts of the invention typically exhibited a transverse rupture strength of at least about 200 MPa. In particular, transverse rupture strengths of 239, 300 and 421 MPa were measured for three compacts prepared by Examples 1, 4 and 6. These results are quite remarkable considering that most of the commercially available rare-earth-iron-boron magnets are too brittle to be extensively handled as well as too brittle to be machined into a transverse rupture bar and to bear even minor applied testing load. The dramatic improvement in mechanical strength of the magnet compacts of the invention appears to result from the enhanced interparticle bonding due to the sphericalness of the particles in conjunction with HIP treatment, which is achieved without the occurrence of excessive grain growth.

While the invention has been described in terms of specific embodiments thereof, it is not intended to be limited thereto but rather only to the extent set forth hereafter in the following claims.

We claim:

1. A method of making an isotropic magnet, comprising the steps of:

a) inert gas atomizing a melt comprising a rare earth and a transition metal to form generally spherical, rapidly solidified rare earth-transition metal alloy particles, b) coating the atomized particles with an environmentally protective coating thereon by contact with a reactive gas downstream of the atomizing location, and c) subjecting the atomized and coated particles to concurrent elevated temperature and elevated isotropic pressure for a time to produce a densified, magnetically isotropic magnet compact.

2. The method of claim 1 wherein the atomized particles are contacted with nitrogen gas to form said coating thereon.

3. The method of cliam 1 wherein the coating comprises an inner nitride layer and an outer graphite layer.

4. A method of making an isotropic permanent magnet, comprising the steps of:

a) inert gas atomizing a melt comprising a rare earth-transition metal alloy to form generally spherical, rapidaly solidified alloy particles wherein a majority of the particles are produced having a particle size less than a larger particle size which larger size exhibits coercivity below about 5 kOe, b) coating the atomized particles with an environmentally protective coating thereon by contact with a reactive gas downstream of the atomizing location, and c) subjecting the atomized and coated particles to concurrent elevated temperature and elevated isotropic pressure for a time to produce a densified, magnetically isotropic magnet compact.

5. The method of claim 4 wherein the atomized particles are contacted with nitrogen gas to form said coating thereon.

6. The method of claim 4 wherein the coating comprises an inner nitride layer and an outer graphite layer.

7. A method of making an isotropic permanent magnet, comprising the steps of:

a) inert gas atomizing a melt comprising a rare earth-transition metal alloy to from generally spherical, rapidly solidified alloy powder in a range of particle sizes, b) coating the atomized powder with an environmentally protective coating thereon by contact with a reactive gas downstream of the atomizing location, and c) separating the atomized and coated powder into one or more particle size fractions, and d) subjecting the atomized and coated powder of a particular size fraction to concurrent elevated temperature and elevated isotropic pressure for a time to produce a densified, magnetically isotropic magnet compact.

8. The method of claim 7 wherein the atomized powder is contacted with nitrogen gas to from said coating thereon.

9. The method of claim 7 wherein the coating comprises an inner nitride layer and an outer graphite layer.

10. A method of making an isotropic permanent magnet, comprising the steps of:

a) inert gas atomizing a melt comprising a rare earth-iron-boron alloy to form generally spherical, rapidly solidified alloy powder in a range of particle sizes, b) coating the atomized powder with an environmentally protective coating thereon by contact with a reactive gas downstream of the atomizing location, c) separating the atomized and coated alloy powder into one or more particle size fractions, and d) subjecting the atomized and coated powder of a particular size fraction to concurrent elevated temperature and elevated isotropic pressure for a time to produce a densified, magnetically isotropic magnet compact.

11. The method of claim 10 wherein the atomized powder is contacted with nitrogen gas to form said coating thereon.

12. The method of claim 10 wherein the coating comprises an inner nitride layer and an outer graphite layer.

13. A method of making an isotropic magnet, comprising the steps of:

a) atomizing a melt comprising a rare earth and a transition metal to form generally spherical, rapidly solidified rare earth-transition metal alloy particles, b) coating the atomized particles with an environmentally protective coating thereon by contact with a reactive gas downstream of the atomizing location, and c) subjecting the atomized particles to concurrent elevated temperature and elevated isotropic pressure for a time effective to produce particle-to-particle bonding and improved magnetic properties as compared to as-atomized particle magnet properties so as to yield a densified, interparticle-bonded, magnetically isotropic magnet compact.

14. The method of claim 13 wherein the atomized particles are contacted with nitrogen gas to form said coating thereon.

15. A method of making an isotropic permanent magnet, comprising the steps of:

a) atomizing a melt comprising a rare earth-transition metal alloy to produce generally spherical, rapidly solidified alloy particles wherein a majority of the particles are produced having a particle size less than a larger particle size which large size exhibits coercivity below about 5 kOe, b) coating the atomized particles with an environmentally protective coating thereon by contact with a reactive gas downstream of the atomizing location, and c) subjecting the atomized particles to concurrent elevated temperature and elevated isotropic pressure for a time to produce particle-to-particle bonding and improved magnetic properties as compared to as-atomized particle magnetic properties so as to yield a densified, interparticle-bonded, magnetically isotropic magnet compact.

16. The method of claim 15 wherein the atomized particles are contacted with nitrogen gas to from said coating thereon.

17. A method for making an isotropic permanent magnet, comprising the steps of:

a) atomizing a melt of rare earth-transition metal alloy to produce generally spherical, rapidly solidified alloy powder in a range of particle sizes, b) coating the atomized particles with an environmentally protective coating thereon by contact with a reactive gas downstream of the atomizing location, c) separating the atomized alloy powder into one or more particle size fractions, and d) subjecting the atomized powder of a particular size fraction to concurrent elevated temperature and elevated isotropic pressure for a time effective to produce particle-to-particle binding and improved magnetic properties as compared to as-atomized particle magnetic properties so as to yield a densified, interparticle-bonded magnetically isotropic magnet compact.

18. The method of claim 17 wherein the atomized particles are contacted with nitrogen gas to from said coating thereon.

19. A method of making an isotropic permanent magnet, comprising the steps of:

a) atomizing a melt of a rare earth-iron-boron alloy to produce rapidly solidified, generally spherical alloy powder in a range of particle sizes, b) coating the atomized particles with an environmentally protective coating thereon by contact with a reactive gas downstream of the atomizing location, c) separating the atomized alloy powder into one or more particle size fractions, and d) subjecting the atomized powder of a particular size fraction to concurrent elevated temperature and elevated isotropic pressure for a time effective to produce particle-to-particle bonding and improved magnetic properties as compared to as-atomized particle magnetic properties so as to yield a densified, interparticle-bonded, magnetically isotropic magnet compact.

20. The method of claim 19 wherein the atomized particles are contacted with nitrogen gas to form said coating thereon.

* * * * *

UNITED STATES PATENT AND TRADEMARK OFFICE

CERTIFICATE OF CORRECTION

PATENT NO. : 5 242 508

DATED : September 7, 1993

INVENTOR(S) : R. William McCALLUM, et al

It is certified that error appears in the above-identified patent and that said Letters Patent is hereby corrected as shown below:

Column 17, line 52; replace "rapidaly" with ---rapidly---.

Column 18, line 4; replace "to from" with ---to form---.

line 19; replace "to from" with ---to form---.

Column 19, line 16; replace "to from" with ---to form---.

Column 20, line 7; replace "to from" with ---to form---.

Signed and Sealed this

Twenty-fourth Day of May, 1994

Bruce Lehman

*Attest:*

BRUCE LEHMAN

*Attesting Officer*

*Commissioner of Patents and Trademarks*